US005833181A

United States Patent [19]

DesNoyers

[11] Patent Number: 5,833,181

[45] Date of Patent: Nov. 10, 1998

[54] OUTDOOR SUPPORT POST APPARATUS

[75] Inventor: Daniel P. DesNoyers, Mocksville, N.C.

[73] Assignee: Signlite Services, Inc., Mocksville, N.C.

[21] Appl. No.: 819,882

[22] Filed: Mar. 18, 1997

[51] Int. Cl.[6] ..... A45F 3/44

[52] U.S. Cl. ..... 248/156; 248/545

[58] Field of Search ..... 248/156, 545; 40/607, 610

[56] References Cited

U.S. PATENT DOCUMENTS

| | | | |
|---|---|---|---|
| 3,519,234 | 7/1970 | Matson . | |
| 4,249,715 | 2/1981 | Repp | 248/545 |
| 4,258,494 | 3/1981 | Borque | 40/607 |
| 4,259,803 | 4/1981 | Sittler | 40/607 |
| 4,279,104 | 7/1981 | Classen . | |
| 4,326,352 | 4/1982 | Barth | 248/545 X |
| 4,327,514 | 5/1982 | Bourque | 40/607 |
| 4,378,650 | 4/1983 | Ottoson | 40/607 |
| 4,483,506 | 11/1984 | Litwiller | 248/545 |
| 4,524,533 | 6/1985 | Still, Jr. | 40/607 |
| 4,662,305 | 5/1987 | Cline . | |
| 4,667,829 | 5/1987 | Edmund-White | 40/607 X |
| 4,790,092 | 12/1988 | Farmer | 40/607 |
| 4,843,746 | 7/1989 | DesNoyers et al. | 248/156 X |
| 4,874,149 | 10/1989 | Miceli | 248/156 X |
| 4,910,901 | 3/1990 | Boyar | 40/607 |
| 4,921,200 | 5/1990 | Moraly | 248/545 |
| 4,923,157 | 5/1990 | Belamiza | 248/545 X |
| 4,939,877 | 7/1990 | Claffey | 248/156 X |
| 4,951,904 | 8/1990 | Obenshain | 248/156 |
| 5,082,231 | 1/1992 | Knowles | 248/545 |
| 5,181,335 | 1/1993 | Todd | 248/156 X |
| 5,207,402 | 5/1993 | Berry-Tremmel et al. | 248/156 |
| 5,305,976 | 4/1994 | Blanchard | 248/156 |
| 5,335,889 | 8/1994 | Hopkins et al. | 40/607 X |
| 5,375,801 | 12/1994 | Porter | 248/156 |
| 5,533,356 | 7/1996 | DeMasters . | |

FOREIGN PATENT DOCUMENTS

| | | |
|---|---|---|
| 3003-426 | 8/1981 | Germany . |

*Primary Examiner*—Ramon O. Ramirez

*Attorney, Agent, or Firm*—Kennedy Covington Lobdell & Hickman, LLP

[57] ABSTRACT

An outdoor support post includes an anchor ground rod, a base post member including a tubular sheath, an extension post member including a tubular sheath, and a cross post member including a tubular sheath that is perpendicularly mountable to the extension post member for supporting an article thereon. The anchor member includes an angle-iron and two inverted L shaped extensions. One of the L-shaped extensions partially penetrates the ground with the angle-iron and partially extends with the angle-iron in engaging abutment within the base post member for bracing support of the base post member. The second L-shaped extension partially extends with the angle-iron in engaging abutment within the extension post member and in engaging abutment within the base post member for bracing support of both the extension post member and the junction of the base post member and the extension post member. Since the base post member, extension post member, and cross post member consist of tubular sheaths of lightweight extruded plastic, the components of the support post are lightweight and easy to erect and dismantle and to readily transport so as to facilitate repeated temporary use of the support post.

20 Claims, 4 Drawing Sheets

OUTDOOR SUPPORT POST APPARATUS

BACKGROUND OF THE INVENTION

The present invention relates to post-like apparatus such as commonly utilized for erecting signs and, more particularly, to an outdoor support post apparatus particularly adapted for selective assembly and disassembly to facilitate repeated temporary use.

In recent years in the United States, the marketing and sale of homes and other single family dwellings have become increasingly competitive as major real estate brokerage firms have quickly expanded nationwide through franchising. As a result, the manner in which real estate is advertised has become increasingly important. As part of this new awareness and attention to marketing, real estate brokerages have design and put into use distinctive, personalized styles of on-site property sale signs. By way of example, the nationwide chain of Merrill Lynch real estate brokerage firms currently utilizes a distinctive wooden sign post assembly, the design and configuration of which is readily recognizable. Other real estate brokerage firms across the country have adopted the same or highly similar signs.

While such signs provide a marked improvement in construction and appearance over the more simplistic signs previously in widespread use, these new signs are significantly more expensive and cumbersome to use. Typically, the aforedescribed signs are fabricated of conventional "four-by-four" wooden posts, including a vertical post member approximately for to six feet in height and a horizontal post member approximately three feet in length. As will be understood, such materials are relatively expensive. Moreover, such signs are necessarily relatively large and heavy, to the point that such signs cannot be conveniently transported in an ordinary automobile and, in any event, an average real estate agent has difficult handling and erecting such signs. Accordingly, real estate brokerage firms typically hire an independent contractor to erect and take down such signs on-site at property listed by the firm, which of course further increases the overall expense associated with the use of such signs.

DesNoyers et al., U.S. Pat. No. 4,843,746, discloses an outdoor support post apparatus which overcomes many of the disadvantages of the support posts of the prior art. Although a significant improvement over the prior art, however, the support post apparatus of DesNoyers et al. has certain disadvantages. For instance, the base, extension and cross post members which have cores that are formed of wood for providing structural strength to the post apparatus. These post members are therefore often too heavy for some real estate sales agents to handle or are too inconvenient because of their weight to easily transport.

SUMMARY OF THE INVENTION

It is accordingly an object of the present invention to provide an outdoor support post apparatus suitable for use, among other things, as a real estate sales sign, which is relatively inexpensive in comparison with conventional signs and is particularly adapted for selective assembly and disassembly to facilitate repeated temporary use. It is a further object of the present invention to provide such a support post apparatus which is capable of easy erection and dismantlement by ordinary real estate sales personnel and ready transportability from one site to another in most any automobile or like vehicle. Yet a further object of the present invention is to provide a support post that is lighter and easier to handle than the support posts of the prior art.

Briefly described, the outdoor support post apparatus of the present invention includes a base post member, an extension post member, a cross post member mountable to the extension post member for support of an article on the cross post member, and an anchor member for bracing support of the base post member in an upright disposition on a support surface and for bracing support of the extension post member in an upright disposition above the base post member.

In a feature of the present invention, the anchor member extends from the support surface in engaging abutment within both the base post member and the extension post member for bracing support thereof.

In a further feature of the present invention, the base post member and the extension post member each include tubular sheaths having polygonal cross-sections and the anchor member extends in engaging abutment within both sheaths for maintaining a rotational alignment of the polygonal cross-sections about the anchor member when the extension post member is disposed above the base post member.

In the preferred embodiment of the present invention, the base post member includes a tubular sheath having an interior surface that defines a longitudinal opening of rectangular cross-section configured to receive in abutting engagement therein a lower portion of an upright anchor member in a close-fitting relationship for bracing support of the base post member in its upright disposition on the support surface. The extension post member likewise includes a tubular sheath having an interior surface that defines a longitudinal opening of rectangular cross-section configured to receive in abutting engagement therein an upper portion of the upright anchor member in a close-fitting relationship for bracing support of the extension post member in its upright disposition above the base post member. The anchor member preferably includes a linear shaft having an angular cross-section and two elongate rectangular flanges that are orthogonally joined together to define an intersection line, an arm extending outwardly from the intersection line away from and at equal distances to the flanges, and a leg extending from the arm parallel to the intersection line, with the leg and arm preferably forming a L-shaped extension of the anchor member. The leg and the flanges together preferably extend within the extension post member in abutting engagement with the interior surface of the extension post member for bracing support thereof. The anchor member also preferably includes a second arm extending outwardly from the intersection line and a second leg extending from the second arm parallel to the intersection line, with the second arm and leg preferably defining a second L-shaped extension of the anchor member similar to the first L-shaped extension. Moreover, the second leg and the flanges extend together within the base post member in abutting engagement with the interior surface of the base post member for bracing support of the base post member in its upright disposition. The second leg and shaft together also preferably partially penetrate the support surface for stabilization of the support post apparatus on the support surface.

In a further feature of the present invention, the flanges and the leg of the first L-shaped extension of the anchor member together extend at least partially within both the extension post member and the base post member in abutting engagement with the interior surfaces thereof for bracing support of both the extension post member and the base post member in their respective upright dispositions. In an aspect of the present invention, the extension post member rests upon the base post member and the first leg and flanges bridge the junction of the extension post member and the base post member for bracing support of these post members at the junction.

DETAILED DESCRIPTION OF THE PREFERRED EMBODIMENTS

Figure 1:
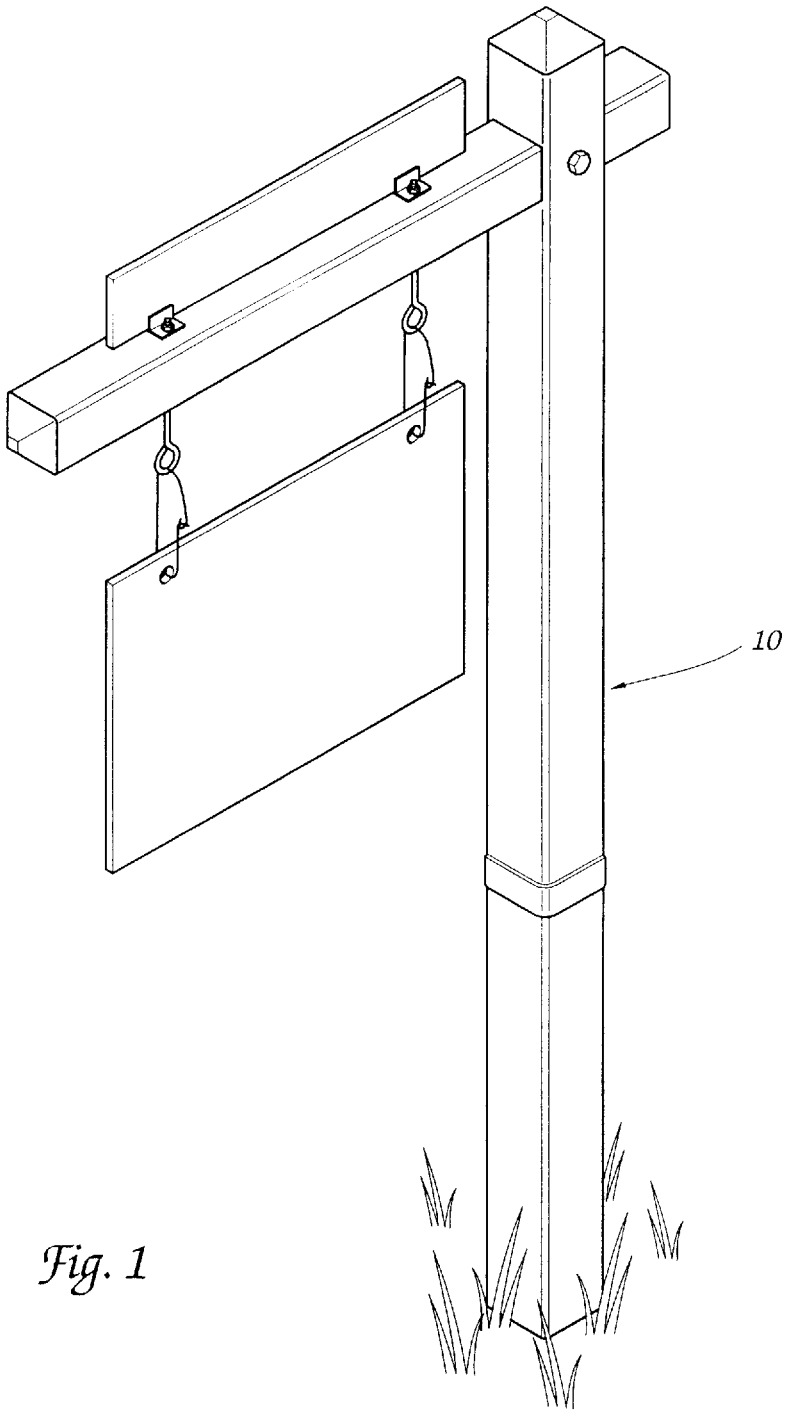
FIG. 1 is a perspective view of an outdoor support post apparatus of the present invention as preferably embodied for use with real estate sales signs.

Referring now to the accompanying drawings, and initially FIG. 1, an outdoor support post apparatus according to the preferred embodiment of the present invention is shown generally at 10. Basically, the post apparatus 10 includes an anchor member 12 (FIGS. 2 and 3), a base post member 14, an extension post member 16, and a cross post member 18.

Figure 2:
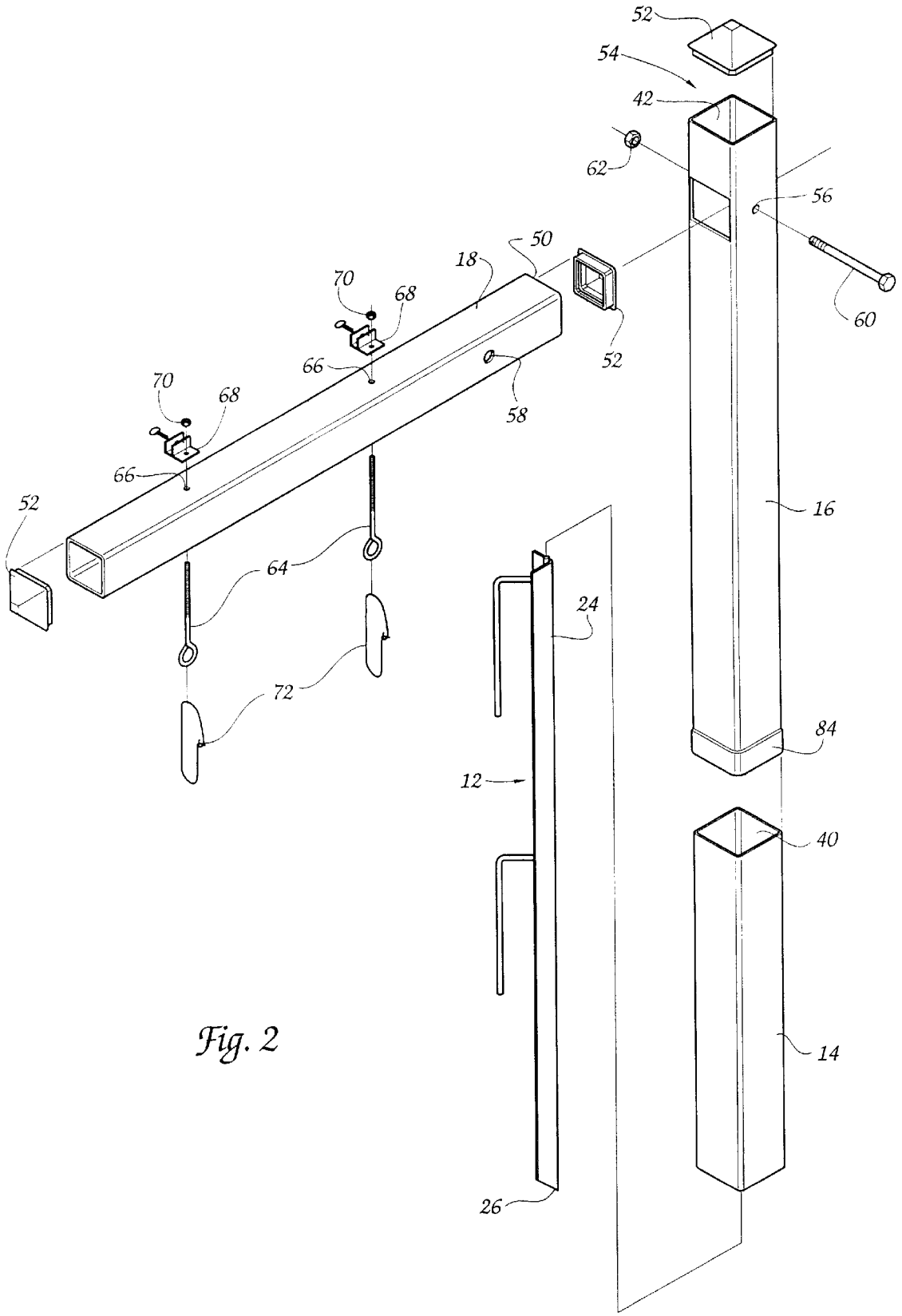
FIG. 2 is an exploded perspective view of the support post apparatus of FIG. 1.
Figure 3:
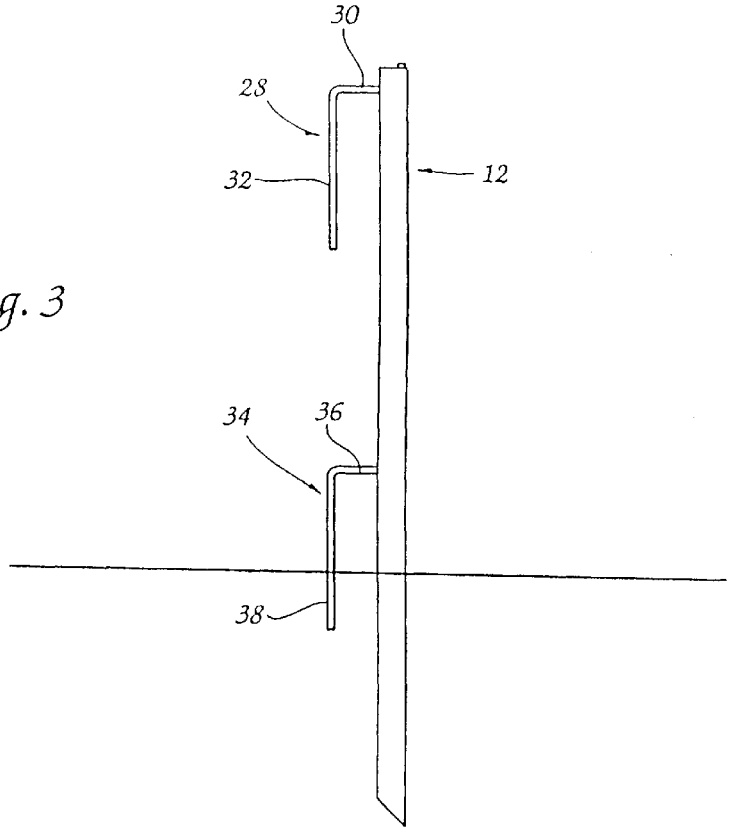
FIG. 3. is a side view of the anchor member of the support post apparatus of FIG. 1.
Figure 5:
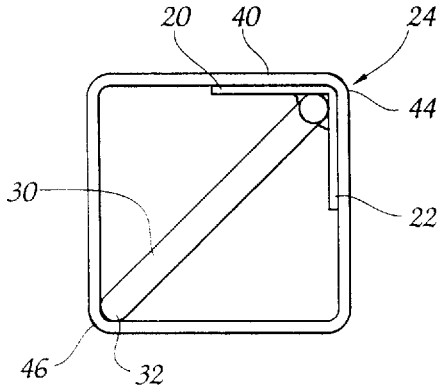
FIG. 5 is a cross-sectional view of the anchor member and base post member of FIG. 4 taken along the line 5—5 and FIG. 6 is a perspective view of a vice-grip clip of the cross post member of the support post apparatus of FIG. 1.
Figure 6:
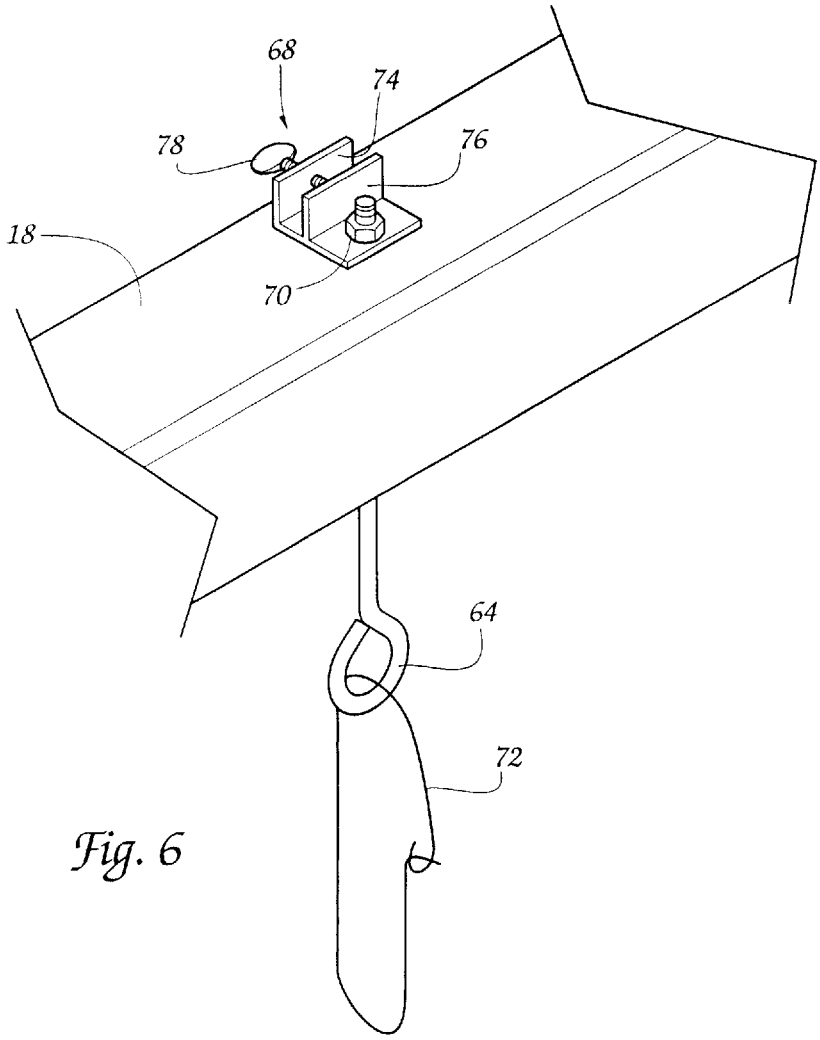

As shown in FIGS. 2, 3, and 5, the anchor member 12 is preferably a substantially linear metal rod or bar having an angular cross-section and including two elongate rectangular flanges 20,22 that are orthogonally joined together to define an intersection line 24, such as a length of conventional angle-iron or a length of conventional iron or steel concrete-reinforcing angular rod. The anchor is preferably forty-five inches in length. As such, the anchor 12 is of a construction adapted to be driven by a conventional hammer or mallet into any earthen area, such as a grassy lawn, at a desired site for erection of the support post apparatus 10, and preferably includes a mitered end 26 of one and one-half inches for breaking through the ground. The anchor 12 includes a first L-shaped extension 28 that has an arm 30 which extends at one end thereof preferably approximately four and one-quarter inches from a first position along the intersection line 24 outwardly away from and at equal distances to the flanges 20,22 and a leg 32 that extends preferably nine and three-quarters inches perpendicularly from the other end of the arm 30 parallel to the intersection line 24. The anchor 12 also includes a second L-shaped extension 34 that has an arm 36 which extends at one end thereof preferably approximately four and one-quarter inches from a second position along the intersection line 24 outwardly from and at equal distances to the flanges 20,22 and a leg 38 that extends preferably approximately nine and three-quarters inches perpendicularly from the other end of the arm 36 parallel to the intersection line 24 in the same direction as the leg 32 of the first L-shaped extension 28.

As best seen in FIGS. 2 and 5, the base post member 14 preferably includes a tubular outer sheath 40 preferably twenty-four inches in length having a rectangular cross-section defining a longitudinal opening approximately three inches by three inches in dimension that extends throughout the length of the base post member 14. The sheath 40 preferably is formed from a length of extruded lightweight plastic tubing. Similar to the base post member 14, the extension post member 16 also preferably includes a tubular outer sheath 42 preferably approximately forty-five inches in length having a rectangular cross-section approximately three inches by three inches in dimension that defines a longitudinal opening extending throughout the length of the extension post member, and also is formed from a length of extruded lightweight plastic tubing.

The cross-sections of the base post member 14 and extension post member 16 are preferably identical, with each post member 14,16 having a uniform cross-section substantially along its respective entire length. However, if desired, the cross-sections of the post members 14,16 may vary between and among themselves as long as the anchor member 12 is insertable within the base post member 14 and the extension post member 16 in abutting engagement with each post member 14,16 in accordance with the present invention.

Figure 4:
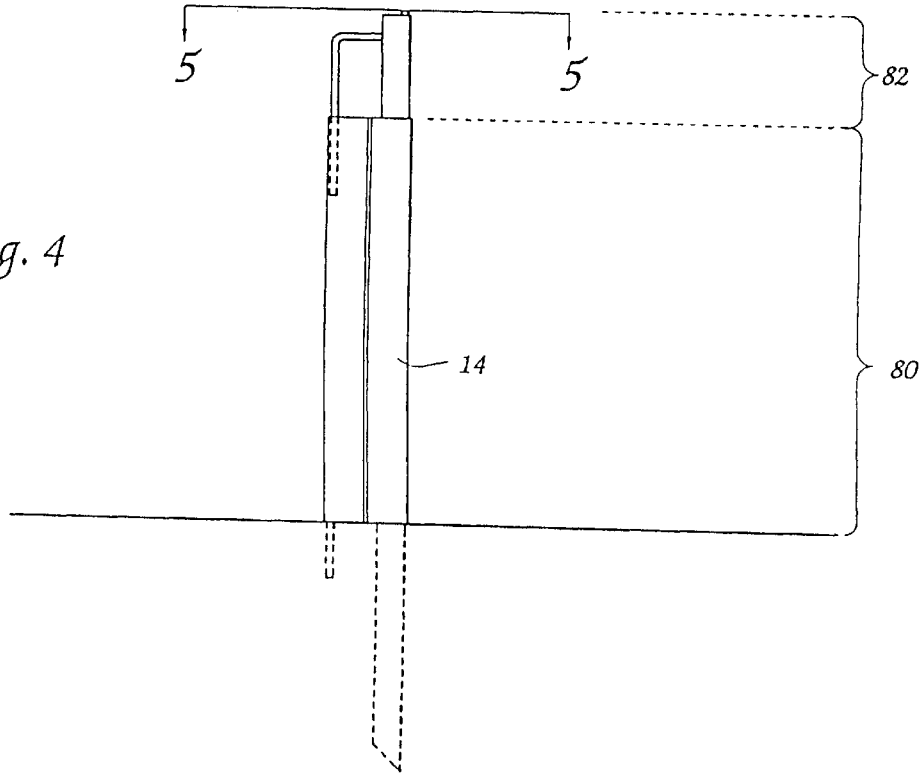
FIG. 4 is a side view of the anchor member and base post member of the support post apparatus of FIG. 1.

Specifically, the preferred cross-sectional configuration and size of the base and extension post members 14,16 are such that the anchor member 12 may be inserted into each post member 14,16 in close-fitting relationship therein. In particular, the base post member 14 preferably slip-fits over the anchor member 12 when the anchor member 12 is, preferably, partially inserted into a support surface so that the rectangular flanges 20,22 and the legs of the L-shaped extensions 32,38 conform to opposed side comers 44,46 of the base post member 14. The conformed fit allows the base post member 14 to be slidably displaced down the anchor member 12 when the anchor member 12 is preferably anchored to the support surface so that the base post member 14 sits on the support surface with the rectangular flanges 20,22 and leg 38 of the second L-shaped extension 34 bracing the base post member 14 from tipping over, from rotating about the anchor member 12, or from otherwise moving short of being slidably lifted off of the anchor member 12. Thus, because of the close-fitting, abutting engagement of the leg 38 and the rectangular flanges 20,22 within the base post member 14, the base post member 14 securely rests on the support surface braced by the anchor member 12 as shown, for example, in FIGS. 1 and 4.

Likewise, the extension post member 16 preferably slip-fits over the anchor member 12 after the base post member 14 so that the rectangular flanges 20,22 and the leg 32 of the first L-shaped extension 28 conform to opposed side corners 44,46 of the extension post member 16. The conformed fit allows the extension post member 16 to be slidably displaced down the anchor member 12 into resting engagement above and on top of the base post member 14 with the rectangular flanges 20,22 and leg 32 of the first L-shaped extension 28 bracing the extension post member 16 from tipping over or from rotating about the anchor member 12, or from otherwise moving short of being lifted off of the anchor member 12. Thus, because of the close-fitting, abutting engagement of the leg 32 and the rectangular flanges 20,22 within the extension post member 16, the anchor member 12 braces the extension post member 16 in its disposition above the base post member 14. Moreover, in the preferred embodiment, the leg 32 of the first L-shaped extension 28 extends within the extension post member 16 and the base post member 14 thereby bridging the junction between the two post members 14,16 to brace the junction of the two post members 14,16 against movement and separation.

The extension post member 16 includes an opening 48 for the mounting of the cross post member 18 perpendicularly through the extension post member 16 transversely to its length. The cross post member 18 includes a tubular outer sheath 50 having a rectangular cross-section defining a longitudinal opening that extends throughout the length of the cross post member 18, with the sheath 50 preferably being formed from a length of thirty-seven inches of extruded lightweight plastic tubing. Unlike the base post member 14 and extension post member 16, however, the cross post member 18 does not receive any structure through the longitudinal opening. Instead, the cross post member 18 includes the longitudinal opening for the reduction in the weight of the cross post member 18 for ease of manipulation by virtually any real estate sales agent. Nevertheless, end caps 52 can be inserted into the ends of the cross post member 18 and the upward end 54 of the extension post member 16 for a more enhanced appearance of the support post apparatus 10.

A bore 56 is formed in two corresponding sides of the extension post member 16 transverse to the cross post opening 48 and a corresponding bore 58 is formed in two corresponding sides of the cross post member 18. Thus, the extension and cross post members 16,18 are adapted to be mounted to one another in substantially perpendicular relationship by inserting a bolt 60 through the bores 56,58 in the extension and cross post members 16,18 when the cross post member 18 is inserted into the cross post opening 48. Furthermore, the bolt 60 is preferably attached thereto by a wing nut 62 for the securing of the cross post member 18 within the extension post member 16.

Other bolts 64 can be passed through selected openings 66 in the cross post member 18 to facilitate the hanging of a sign on the support post apparatus 10. Specifically, the cross-post member 18 preferably includes at least two pair of corresponding openings 66 in the upward side and downward side of the cross post member 18 for the passage therethrough of the bolts 64. Preferably, the bolts 64 are passed from the bottom side towards the upward side, extend through conventional vice-grip clips 68 positioned on the upward side of the cross post member 18, and are secured there by nuts 70. The bolts 64 include eyelets on the downward side ends of the bolts 64 through which clips 72 can be attached for extension thereof through openings in a sign for the hanging of the sign on the support post apparatus 10. The vice-grip clips 68, disposed on the upward side of the cross post member 18 and secured thereat by the nuts 70 and bolts 64, each include two upwardly projecting flanges 74,76 with one flange 74 having an opening through which a threaded bolt 78 extends. Thus, an additional sign, such as a "under contract" or "sold" sign, can be placed between the flanges 74,76 of each vice-grip clip 68 when aligned on top of the cross post member 18, and the additional sign can be secured thereat by pressure applied between the threaded bolts 78 and the flanges 76. Alternatively, other conventional means may also be utilized in attaching a sign to the support post apparatus 10 as desired.

In order to erect the support post apparatus 10, the anchor member 12 is initially preferably driven in an upright disposition into the earth at a desired location to a sufficient depth, usually to a preferably minimum depth of thirteen inches or more to stabilize the anchor member 12. Moreover, the anchor member is preferably driven at a five degree lean-back angle for compensating for the weight of the cross-post member 12 and the signs, once attached.

The second L-shaped extension 34 is preferably located at a position preferably approximately twenty-two inches from the bottom of the anchor member 12 along the intersection line 24 so that part of the leg 38 of the second L-shaped extension 34 is also driven into the ground for further stabilization of the support post apparatus 10 as shown in FIG. 3 for example. The base post member 14 is then mounted on the anchor member 12 by slidable insertion of the upright exposed extent of the anchor member 12 into the longitudinal opening of the base post member 14. Moreover, the base post member 14 is preferably uniform and thus either end of the base post member 14 may be first inserted over the anchor member 12.

Once the anchor member 12 has been slidably extended through the base post member 14 so that the base post member 14 contacts and rests upon the ground with the base post member 14 in abutting engagement with the rectangular flanges 20,22 and leg 38 of the second L-shaped extension 34 of the anchor member 12, the base post member 14 preferably covers a lower portion 80 of the anchor member 12 so that the base post member 14 also partially rests in abutting engagement with the leg 32 of the first L-shaped extension 28 of the anchor member 12 which extends from the intersection line 24 preferably approximately forty-three and one-half inches from the bottom of the anchor member 12. Thus, both L-shaped extensions 28,34 of the anchor member 12 brace the base post member 14 in the preferred embodiment.

The extension post member 16 is mounted on the anchor member 12 by slidable insertion of the upright exposed upper portion 82 of the anchor member 12 into the longitudinal opening of the extension post member 16. Furthermore, the anchor member 12 is inserted into the extension post member 16 at an end of the extension post member 18 opposite the opening therein for receiving the cross post member (opposite end 54) so that the cross post member 18 is mounted at a high elevation of the support post apparatus 10. Once the anchor member 12 has been slidably extended through the extension post member 16, the extension post member 16 preferably rests upon the base post member 14 in abutting engagement with the rectangular flanges 20,22 of the anchor member 12 and part of the leg 32 of the first L-shaped extension 28 of the anchor member 12. Moreover, an overhanging lip 84 of approximately one and one-half inches in length is preferably included as part of the extension post member 16 for slight overhanging of the base post member 14 by the extension post member 16 so that the resting engagement of the base post member 14 and the extension post member 16 is covered from view, thereby providing an enhanced appearance of the support post apparatus 10. Furthermore, the lip 84 preferably has a gradual increase in cross-section for snugly receiving the base post member 14.

Once the anchor member 12, base post member 14, and extension post member 16 have been assembled, the cross post member 18 is inserted through the opening 48 in the extension post member 16 for perpendicularly mounting the cross post member 18 to the extension post member 16. Specifically, the bolt 60 is inserted through the corresponding bores 56,58 in the extension and cross post members 16,18 for interlocking engagement of the cross post member 18 and the extension post member 16, with the wing nut 62 being attached to the bolt 60 for securement of the bolt 60 to the extension post member 16.

Finally, a sign is hung from the cross post member 18 in the desired manner, preferably by extending the bolts 64 through the openings 66 in the cross post member 18, securing the bolts 64 to the cross post member 18 by nuts 70, and attaching hanging clips 72 to eyelets in the bolts 64. In addition, the same bolts 64 preferably secure vice-grip clips 68 to the upward side of the cross post member 18 for attaching an additional sign to vice-grip clips 68 on top of the cross post member 18.

The support post apparatus 10 is taken down and disassembled by reversing the described steps of the assembly process.

As will thus be understood, the support post apparatus is readily capable of easy assembly and disassembly as desired. When disassembled, the anchor, base post, extension post, and cross post members as well as any signs used therewith are of course separate components that may be conveniently arranged for storage and transportation as desired, either in the trunk or the interior passenger area of virtually any conventional automobile or passenger vehicle. Further, each component is lightweight so as not to be a burden to carry or manipulate during the assembling or disassembling of the support post apparatus by virtually any real estate sales agent.

Because the support post apparatus of the present invention is sufficiently lightweight and easy to handle and transport to readily facilitate the erection and dismantlement of the apparatus by virtually any real estate sales agent as has traditionally been one of the functions of the agent, real estate brokerage firms are now able to avoid the necessity of hiring outside contractors to transport, erect and take down real estate sales signs. As an attendant advantage, the support post apparatus of the present invention is less likely than conventional signs to be damaged during the erection and dismantling processes and should have a considerably longer useful life than conventional support post apparatus.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A set of members for constructing an outdoor support post apparatus comprising:

an anchor member for upright disposition on a support surface, said anchor member in said upright disposition including upper and lower portions extending above the support surface;

a base post member comprising a tubular sheath having an interior surface defining a longitudinal opening configured to receive in abutting engagement therewith said lower portion of said anchor member in a close-fitting relationship for bracing support of said base post member in an upright disposition on the support surface;

an extension post member comprising a tubular sheath having an interior surface defining a longitudinal opening configured to receive in abutting engagement therewith said upper portion of said anchor member in a close-fitting relationship for bracing support of said extension post member in an upright disposition above said base post member; and a cross post member for mounting to said extension post member for supporting an article on said cross post member.

2. A set of members for constructing an outdoor support post apparatus according to claim 1, wherein said base post member and said extension post member have identical cross-sections along substantially their entire length.

3. A set of members for constructing an outdoor support post apparatus according to claim 1, wherein said base post member and said extension post member each have a polygonal cross-section of corresponding configuration and size.

4. A set of members for constructing an outdoor support post apparatus according to claim 1, wherein said base post member and said extension post member each include tubular sheaths having polygonal cross-sections and said anchor member extends in engaging abutment within said sheaths for maintaining a rotational alignment of said polygonal cross-sections about said anchor member when said extension post member is in said upright disposition above said base post member.

5. A set of members for constructing an outdoor support post apparatus according to claim 1, wherein said anchor member comprises a linear shaft having an angular cross-section and includes two elongate flanges that are orthogonally joined together to define an intersection line, an arm portion that extends outwardly from said intersection line, and a leg portion that extends from said arm portion parallel to said intersection line, said shaft and said leg portion extending together at least partially within said extension post member and said base post member in abutting engagement with said interior surfaces thereof for bracing support of said extension post member and said base post member in said upright dispositions.

6. A set of members for constructing an outdoor support post apparatus according to claim 5, said anchor member further comprising a second arm portion extending outwardly from said intersection line and a second leg portion extending from said second arm portion parallel to said intersection line, wherein said second leg portion and said shaft extend together within said base post member for bracing support of said base post member in said upright disposition.

7. A set of members for constructing an outdoor support post apparatus according to claim 6, wherein said second leg portion and said shaft together penetrate the support surface for stabilization of the support post apparatus on the support surface.

8. A set of members for constructing an outdoor support post apparatus for temporary use adapted for ease of erection and dismantlement and ready transportability, comprising:

(a) an anchor member for partial penetration in upright disposition in a support surface, said anchor member including (i) a linear shaft having an angular cross-section and including two elongate rectangular flanges that are orthogonally joined together to define an intersection line, (ii) a first L-shaped extension attached to said shaft at a first position along said intersection line and which partially extends away from and at equal distances to said rectangular flanges and which partially extends parallel to said intersection line, and (iii) a second L-shaped extension attached to said shaft at a second position along said intersection line which partially extends away from and at equal distances to said rectangular flanges and which partially extends parallel to said intersection line;

(b) a base post member comprising a tubular sheath having a rectangular cross-section defining a longitudinal opening for receiving in abutting engagement therewith said rectangular flanges and said, second L-shaped extension partially extending parallel to said intersection line for bracing support of said base post member in an upright disposition on the support surface;

(c) an extension post member comprising a tubular sheath having a rectangular cross-section defining a longitudinal opening for receiving in abutting engagement therewith said rectangular flanges and said first L-shaped extension partially extending parallel to said intersection line for bracing support of said extension post member in an upright aligned disposition on top of said base post member; and (d) a cross post member for mounting to said extension post member for supporting an article on said cross post member.

9. A set of members for constructing an outdoor support post apparatus according to claim 8, wherein said anchor extends in engaging abutment within said sheaths for maintaining a rotational alignment of said rectangular cross-sections about said shaft when the support post is constructed with said extension post member in said upright disposition above said base post member.

10. A set of members for constructing an outdoor support post apparatus according to claim 8, wherein said first L-shaped extension partially extending parallel to said intersection line and said rectangular flanges together at least partially extend in both said base post member and said extension post member in abutting engagement therewith for vertically bracing support thereof in said upright dispositions when the support post is constructed.

11. A set of members for constructing an outdoor support post apparatus according to claim 10, wherein said second L-shaped extension and said shaft extend together within said base post member for bracing support of said base post member in said upright disposition on the support surface and at least partially penetrate the support surface for stabilization of said anchor member in the support surface in said upright disposition when the support post is constructed.

12. A set of members for constructing an outdoor support post apparatus for temporary use adapted for ease of erection and dismantlement and ready transportability, comprising:

(a) an anchor member for partial penetration in upright disposition in a support surface, said anchor member including (i) a linear shaft having an angular cross-section and including two elongate rectangular flanges that are orthogonally joined together to define an intersection line, (ii) a first L-shaped extension attached to said shaft at a first position along said intersection line and which partially extends away from and at equal distances to said rectangular flanges and which partially extends parallel to said intersection line, and (iii) a second L-shaped extension attached to said shaft at a second position along said intersection line which partially extends away from and at equal distances to said rectangular flanges and which partially extends parallel to said intersection line;

(b) a post member comprising a tubular sheath having a rectangular cross-section defining a longitudinal opening for receiving in abutting engagement therewith said rectangular flanges and said first and said second L-shaped extensions partially extending parallel to said intersection line for bracing support of said post member in an upright disposition on the support surface; and (c) a cross post member for mounting to said post member for supporting an article on said cross post member.

13. A set of members for constructing an outdoor support post apparatus according to claim 12, wherein said anchor extends in engaging abutment within said sheath for maintaining a rotational alignment of said rectangular cross-section about said shaft when the support post is constructed.

14. A set of members for constructing an outdoor support post apparatus according to claim 12, wherein said second L-shaped extension and said shaft extend together within said post member for bracing support of said post member in said upright disposition on the support surface and at least partially penetrate the support surface for stabilization of said anchor member in the support surface in said upright disposition when the support post is constructed.

15. A set of members for constructing an outdoor support post apparatus comprising:

an anchor member for upright disposition on a support surface, said anchor member including upper and lower portions disposed above an end of said anchor member to be anchored in the support surface;

a base post member comprising a tubular sheath having an interior surface defining a longitudinal opening configured to receive in abutting engagement therewith said lower portion of said anchor member in a close-fitting relationship for bracing support of said base post member in an upright disposition on the support surface;

an extension post member comprising a tubular sheath having an interior surface defining a longitudinal opening configured to receive in abutting engagement therewith said upper portion of said anchor member in a close-fitting relationship for bracing support of said extension post member in an upright disposition above said base post member; and a cross post member for mounting to said extension post member for supporting an article on said cross post member;

wherein said upper portion of said anchor member includes a linear shaft having an angular cross-section defined by two elongate flanges that are orthogonally joined together to define an intersection line, an arm portion that extends outwardly from said intersection line, and a leg portion that extends from said arm portion parallel to said intersection line, said shaft and said leg portion extendable together at least partially within said extension post member and said base post member in abutting engagement with said interior surfaces thereof for bracing support of said extension post member and said base post member in the upright dispositions when the support post is constructed.

16. A set of members for constructing an outdoor support post apparatus according to claim 15, wherein said lower portion of said anchor member includes a second arm portion extending outwardly from said intersection line and a second leg portion extending from said second arm portion parallel to said intersection line, said second leg portion and said shaft extendible together within said base post member for bracing support of said base post member when in the upright disposition when the support post is constructed.

17. A set of members for constructing an outdoor support post apparatus according to claim 16, wherein said second leg portion and said shaft together are extendable into the support surface for stabilization of the support post apparatus on the support surface when the support post is constructed.

18. A set of members for constructing an outdoor support post apparatus comprising:

an anchor member for upright disposition on a support surface, said anchor member including upper and lower portions disposed above an end of said anchor member to be anchored in the support surface;

a post member including a base post portion and an upper post portion, said base post portion comprising a tubular sheath having an interior surface defining a longitudinal opening configured to receive in abutting engagement therewith said lower portion of said anchor member in a close-fitting relationship for bracing support of said post member in an upright disposition on the support surface when the support post is constructed;

said upper post portion comprising a tubular sheath having an interior surface defining a longitudinal opening configured to receive in abutting engagement therewith said upper portion of said anchor member in a close-fitting relationship for further bracing support of said post member in the upright disposition on the support surface when the support post is constructed; and a cross post member for mounting to said upper post portion for supporting an article on said cross post member;

wherein said upper portion of said anchor member includes a linear shaft having an angular cross-section defined by two elongate flanges that are orthogonally joined together to define an intersection line, an arm portion that extends outwardly from said intersection line, and a leg portion that extends from said arm portion parallel to said intersection line, said shaft and said leg portion extendable together at least partially within said upper post portion and said base post portion in abutting engagement with said interior surfaces thereof for bracing support of said post member in the upright disposition on the support surface when the support post is constructed.

19. A set of members for constructing an outdoor support post apparatus according to claim 18, wherein said lower portion of said anchor member includes a second arm portion extending outwardly from said intersection line and a second leg portion extending from said second arm portion parallel to said intersection line, said second leg portion and said shaft extendable together within said post member for bracing support of said post member when in the upright disposition when the support post is constructed.

20. A set of members for constructing an outdoor support post apparatus according to claim 18, wherein said second leg portion and said shaft together extendable into the support surface for stabilization of said post member on the support surface when the support post is constructed.

* * * * *